United States Patent [19]

Smith

[11] 4,261,813

[45] Apr. 14, 1981

[54] DENITROGENATION OF OILS WITH REDUCED HYDROGEN CONSUMPTION

[75] Inventor: Robert H. Smith, Plano, Tex.

[73] Assignee: Atlantic Richfield Company, Los Angeles, Calif.

[21] Appl. No.: 91,548

[22] Filed: Nov. 5, 1979

[51] Int. Cl.[3] ..... C10G 45/02; C10G 67/04

[52] U.S. Cl. ..... 208/254 H; 208/87; 208/95

[58] Field of Search ..... 208/87, 95, 254 R, 254 H

[56] References Cited

U.S. PATENT DOCUMENTS

| | | | |
|---|---|---|---|
| 2,263,176 | 11/1941 | Lazar et al. | 208/254 R |
| 2,662,843 | 12/1953 | Castner et al. | 208/254 R |
| 2,704,758 | 3/1955 | Wetzel | 546/181 |
| 4,113,607 | 9/1978 | Miller | 208/254 R |
| 4,159,940 | 7/1979 | Smith | 208/254 H |

*Primary Examiner*—Delbert E. Gantz
*Assistant Examiner*—G. E. Schmitkons
*Attorney, Agent, or Firm*—Wofford, Fails & Zobal

[57] ABSTRACT

A method of denitrogenating an oil containing a relatively high concentration of nitrogenous compounds characterized by, first, extracting the nitrogenous compounds from the oil with an operable acid solvent to produce a raffinate of low nitrogen content oil and a bottoms of high nitrogen content oil; then recovering the acid solvent from the bottoms, simultaneously producing a small volumeteric flow rate stream of oil containing high content of nitrogenous compounds; depending upon the volumeteric rate of the high nitrogen content oil stream and upon demand, sending it to a hydrogen producing plant for supplying hydrogen for hydrogenation; and recycling the acid solvent. Preferred acid solvents comprise phosphoric acid, formic acid or the monoammonium salt of phosphoric acid. The recovery of the solvent may be by neutralization or by distillation. Also disclosed are complete process steps including an initial hydrogenation step before the extraction; the washing of the oil streams before they are sent to their destinations; and hydrodenitrogenation of the low nitrogen raffinate oil.

8 Claims, 5 Drawing Figures

DENITROGENATION OF OILS WITH REDUCED HYDROGEN CONSUMPTION

FIELD OF THE INVENTION

This invention relates to a method of removing catalyst-poisoning impurities, or contaminants; such as, nitrogen and nitrogen-containing compounds; from hydrocarbonaceous fluids, or oils; such as synthetic crude oil, synthetic oil fractions, oils derived from coal and shale and the like.

DESCRIPTION OF THE PRIOR ART

The prior art has included the development of many types of energy. With the current scarcity and projected shortage of the fossil fuel sources of energy, there has been a resurgence of interest in sources of energy that were formerly not competitive. These sources of energy include the shale oil, or kerogen, such as derived from oil shale; the fluids, such as methanol or coal gas, that are synthesized from coal; and bitumen from tar sands and the like. Many of these hydrocarbonaceous fluids contain contaminants that need to be removed before further processing. Typical of these contaminants are nitrogen and nitrogen-containing compounds, generally referred to as the nitrogenous compounds. For example, the coal liquids contain concentrations on the order of 0.5–1.5 percent (%) by weight of the nitrogen compounds. Shale oil contains more than two percent (2%) nitrogenous compounds. The nitrogen compounds are poisons for precious metal reforming catalysts and to a lesser degree for catalytic cracking catalysts which are used in petroleum refining processes. The nitrogen in liquid fuels produced from shale oil or coal liquids is partially converted to nitrogen oxides on combustion. Burning oils with nitrogen contents in the range of raw coal liquids or shale oil could result in violation of air pollution regulations for nitrogen oxides.

The nitrogen is contained predominantly in five or six membered ring structures in coal liquids. Nitrogen compounds which boil above eight hundred degrees F (800° F.) are in multi-ring aromatic and heterocyclic structures. Aromatic ring compounds exhibit exceptional stability because of the resonance of the $\pi$ hydrogen bonds. This is also true for heterocyclic nitrogen compounds as well. Consequently, in order to remove nitrogen from the ring structures, the carbonnitrogen bonds must be broken by cracking. Saturated rings do not have the resonance stability of aromatic rings and hence rupture more easily. Experimental evidence suggests that hydrocracking of aromatic rings occurs by, first, saturation of the aromatic rings, followed by cracking. In polycyclic structures, the outer rings are hydrogenated and ruptured first. The remaining single aromatic rings are very stable and are likely to remain unchanged at hydrocracking conditions.

At the high reaction severity required to hydrogenate coal or shale liquids, as well as other synthetic oils, a large amount of hydrogen is consumed in reaction with the hydrocarbons present.

There are numerous patents and literature articles directed to these conditions of hydrogenation of shale oil and coal liquids. All these articles point out the severe hydrogenation condition of high temperature, high hydrogen partial pressure and low space velocities that are required to reduce nitrogen contents to acceptable levels. At the severe conditions required for denitrogenation, hydrogen consumption is large. For example, in hydrogenation of one oil, conditions of 720° F., 3,000 pounds per square inch gage (psig), and 1.0 volumeteric hourly space velocity were required to reduce the nitrogen content from 1% to 0.25%. The resulting hydrogen consumption was 2300 standard cubic feet (scf) per barrel.

The closest prior art of which I am aware is my U.S. Pat. No. 4,159,940, the descriptive matter of which is incorporated herein by reference for details omitted herefrom. In that patent was described a process of acid extraction of the contaminants, followed by hydrodenitrogenation of oil stream having high nitrogenous compound content. Because the volumetric rate of the high nitrogen content oil is low, it is often uneconomical to hydrodenitrogenate or otherwise dispose of the stream.

From the foregoing, it can be seen that the prior art has not provided an economical method for denitrogenation and it is desirable to achieve a reduction in hydrogenation severity and hydrogen consumption so as to make a major improvement in the economics of upgrading the liquids containing a relatively high concentration of nitrogenous compounds.

SUMMARY OF THE INVENTION

Accordingly, it is an object of this invention to provide a method of removing a contaminant, such as nitrogen, from an oil feed stock that reduces the severity of hydrogenation, and the consumption of hydrogen and is therefore economically advantageous.

It is a particular object of this invention to provide a method of reducing the nitrogenous compounds in an oil stream so as to reduce the reaction severity required to hydrogenate the nitrogenous compounds, thereby alleviating the difficulties and deficiencies of the prior art and increasing the economic feasibility of such denitrogenation processes.

These and other objects will become apparent from the descriptive matter hereinafter, particularly when taken in conjunction with the appended drawings.

In accordance with this invention, there is provided a method of denitrogenating an oil containing a relatively high concentration of nitrogenous compounds comprising the steps of:

(a) extracting the nitrogenous compounds from the oil stream with an operable acid solvent to produce a raffinate oil containing a relatively low concentration of nitrogenous compounds and a bottoms containing a high concentration of nitrogenous compounds;

(b) recovering the acid solvent from the bottoms, simultaneously producing a relatively small volumeteric flow rate stream of oil containing the high concentration of nitrogenous compounds, called a high nitrogen content oil;

(c) sending the high nitrogen content oil to a hydrogen producing plant for supplying hydrogen for hydrogenation; and (d) recycling the acid solvent.

The operable acid solvent is preferably formic or phosphoric acid or a monoammonium salt of phosphoric acid. The acid solvent is recovered by either disillation or neutralization.

Preferably, the high nitrogen content oil is washed before being sent on to the hydrogen producing plant.

In one embodiment of the method of this invention, the high nitrogen oil is sent to a hydrodenitrogenation unit where the nitrogen content is reduced to a lower concentration before the extracting of the remaining nitrogen compounds is carried out.

DESCRIPTION OF THE PREFERRED EMBODIMENTS

It is realized that, as implied from the descriptive matter hereinbefore, this invention is usable on any oil that has a relatively high concentration of nitrogenous compounds. These oils may be produced from a wide variety of sources. This invention is particularly useful with the oil streams usually referred to as syncrude, such as obtained from oil shale, tar sands, and coal.

Figure 1:
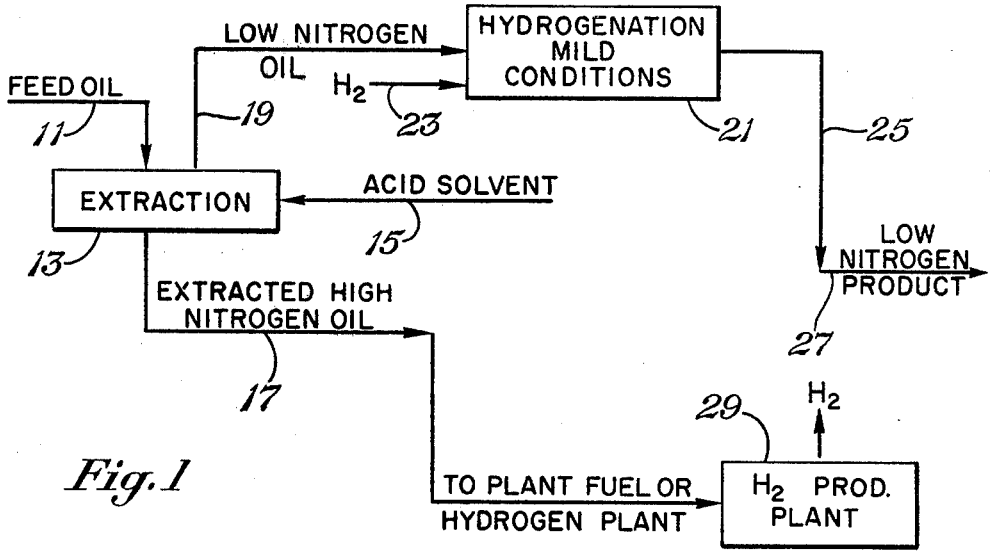
FIG. 1 is a master flow diagram showing broadly the flow of the process in accordance with one embodiment of this invention involving extraction followed by denitrogenation.

It is believed advisable to consider an overview of the broad steps of the invention Referring to FIG. 1, the feed oil 11 is sent to an extraction tower 13 to which is also fed the acid solvent 15. The acid solvent admixes with the feed oil and extracts, or dissolves, the nitrogenous compounds. Most of the nitrogenous compounds are extracted by the acid solvent and fall with any excess acid solvent and the heavier ends to the bottoms to produce a bottoms stream 17 that is high in concentration of the nitrogenous compounds. Consequently, there is produced a raffinate stream 19 of oil that is relatively low in concentration of nitrogenous compounds. Specifically, the raffinate is at least twenty percent (20%) lower in the concentration of nitrogenous compounds than is the feed oil stream 11.

The raffinate is then hydrogenated in the mild hydrogenation tower 21 to which is also sent hydrogen stream 23. The hydrogenated effluent stream 25 then has a low concentration of nitrogen and forms the product stream 27.

The bottoms stream 17 is a relatively low value stream of oil containing a high concentration of the nitrogenous compounds, called a high nitrogen content oil. The high nitrogen content oil is sent to the hydrogen producing plant 29. This allows conserving a more valuable stream that would otherwise have to be employed to produce hydrogen. As will be described later hereinafter, the byproducts of the hydrogen producing plant also includes ammonia formed by reaction of the nitrogenous compounds with the hydrogen. The ammonia then can be employed in producing fertilizer, ammonium hydroxide, ammonia gas or the like as the market dictates.

The mild hydrogenation tower 21 can be somewhat smaller than usual and conserve energy and hydrogen because of the reduced nitrogen content, or lower concentration of nitrogenous compounds, effected by the previous extraction.

Figure 2:
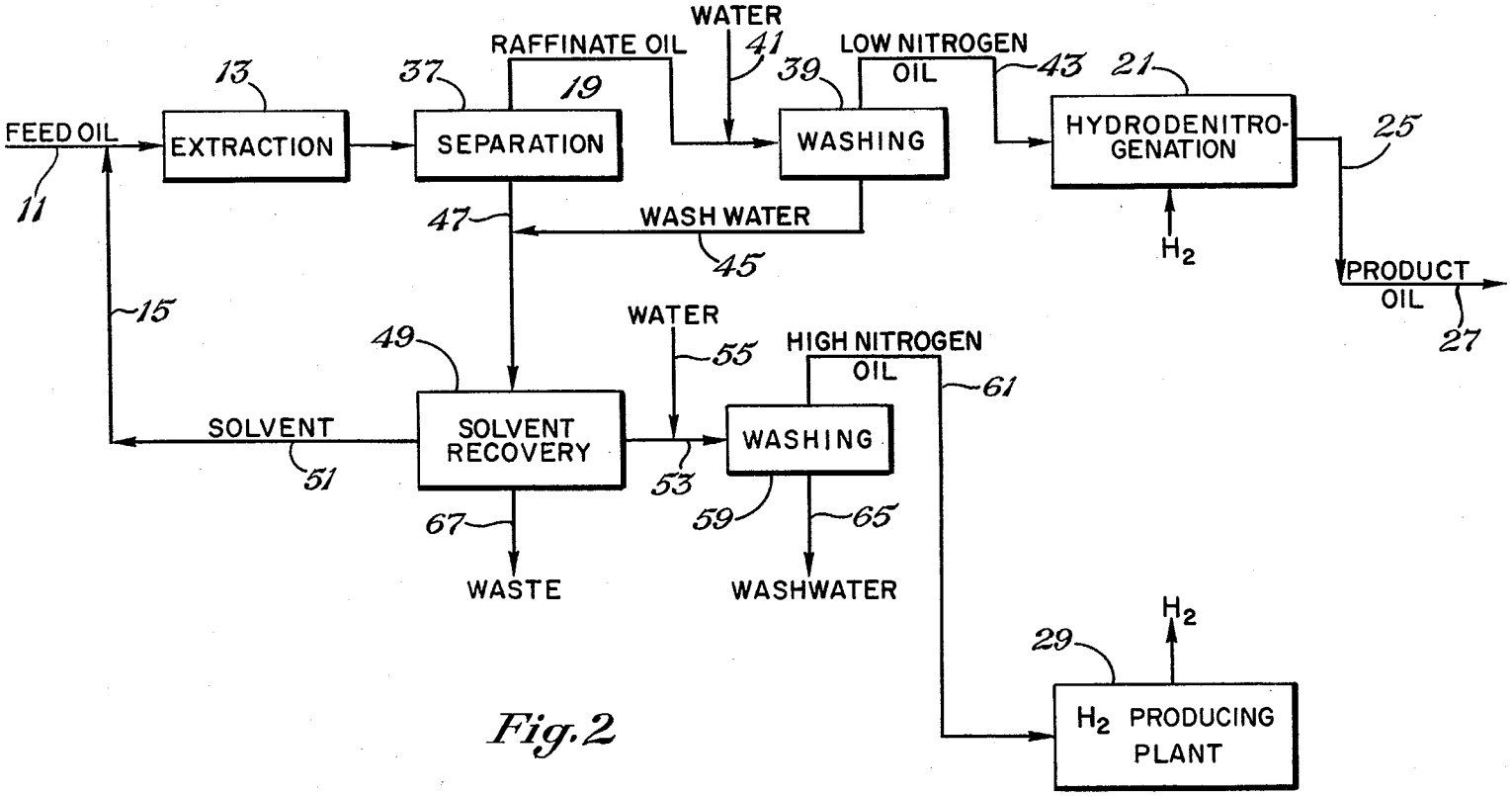
FIG. 2 is a somewhat more detailed flow diagram of the embodiment of FIG. 1.

The invention is illustrated in more detail in FIG. 2. Therein, the feed stream 11 has the acid solvent 15 admixed therewith before being sent to the extraction tower 13. Preferably, at least five percent (5%) by weight is employed, although the proportion is determined by economical considerations. Following the extraction tower 13, there is separation in the separation tower, or separator, 37. The separation is into two phases which have a different densities, the lighter being referred to herein as the raffinate. Following separation the raffinate oil stream 19 is then passed through a washing tower 39 after a water stream 41 has been added to the oil. As a consequence, the washed low nitrogen oil stream 43 is then sent to the hydrodenitrogenation unit 21, which is the same as the mild hydrogenation tower 21. In the hydrodenitrogenation unit 21, there is produced ammonia and hydrogen sulfide as by-products. The oil containing these by-products is washed with water and the stream cooled. Consequently, the ammonia and hydrogen sulfide are dissolved and reacted to provide a bottoms including an aqueous solution of ammonium sulfide, inter alia. Gaseous hydrogen is taken off a flash tower as overhead and recycled. The oil product with the nitrogenous compounds removed, at least to a satisfactorily low concentration, passes through line 25 to the product stream 27 as described hereinbefore.

The bottoms from the washing tower 39 comprise wash water stream 45 containing the acid and the like that has been washed from the raffinate oil stream 19. The wash water stream 45 is added to the bottom stream 47 from the separation tower 37 and sent to the solvent recovery unit 49.

In the solvent recovery unit 49, the acid solvent is recovered and sent via the acid solvent conduit 51 to be recycled via the acid solvent line 15. An oil stream 53 has added to it water stream 55 and sent to washing tower 59 where the undesirable components are washed from the oil having a high concentration of nitrogenous compounds, labeled HIGH NITROGEN OIL in FIG. 2. The high nitrogen oil stream 61 is then sent to hydrogen producing plant 29. As is recognized, the hydrogen producing plant produces synthesis gas (hydrogen and carbon monoxide) hydrogen sulfide, carbon dioxide, and ammonia. The synthesis gas is separated as the desired stream. The carbon monoxide in the synthesis gas is frequently reacted with water to produce more hydrogen for the hydrogenation in tower 21 or elsewhere. Other products such as the ammonia can be recovered or inter-reacted as the market makes most profitable at a given time.

The wash water stream 65 goes out the bottom from the wash tower 59. Depending upon the contents of the wash water, it may be further processed for recovery of valuable constituents as noted from FIG. 3 hereinafter. In the event that solvent recovery is incomplete in stream 67 a second solvent recovery unit can be employed.

Figure 3:
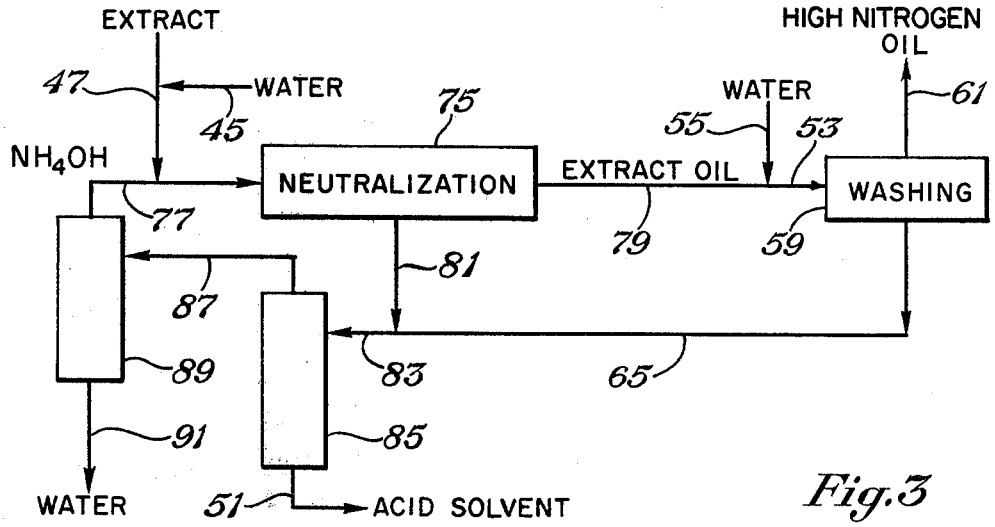
FIG. 3 is a flow diagram showing the recovery of acid solvent by neutralization.
Figure 4:
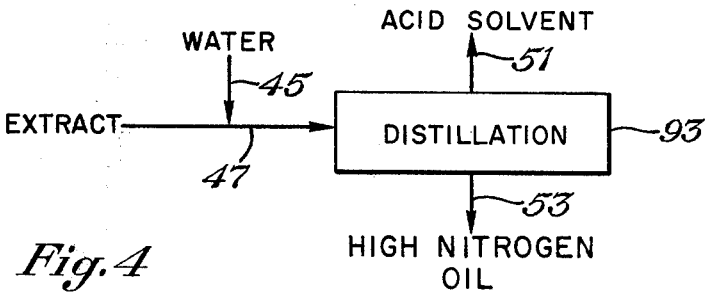
FIG. 4 is a flow diagram showing recovery of the acid solvent by distillation.

The solvent recovery unit may comprise either a neutralization unit such as illustrated in FIG. 3 or a distillation unit such as illustrated in FIG. 4, depending in part upon the acid solvent employed. As indicated hereinbefore, the acid solvent may be either phosphoric acid, formic acid or, a monoammonium salt of phosphoric acid.

As can be seen in FIG. 3, the extract stream 47 has ammonium hydroxide added to it and is sent to the neutralization vessel 75. Wash water may have been added through stream 45. The ammonium hydroxide is added via conduit 77. The overhead stream 79 will be the extract oil from which most of the acid solvent has been removed. This is substantially the same stream as sent by conduit 53 to which was added water 55 and sent to the washing tower 59 in FIG. 2. The high nitrogen oil stream 61 then is sent to the hydrogen producing plant 29 as described hereinbefore. Obviously if hydrogen producing plant needs feed this is a good, low value stream to supply to the hydrogen producing plant 29.

The bottom stream 81 from the neutralizing vessel 75 is added to the wash water stream 65 from the washing tower 59. If phosphoric acid or the monoammonian salt of phosphoric acid is employed, the resulting solution in the combined stream 83 includes ammonium phosphate solution. It is then sent to a phosphoric acid recovery tower 85 and the acid solvent is then recovered and sent via conduit 51 to be recycled to the extraction tower 13, FIG. 2. The top stream 87 from the phosphoric acid tower 85 will comprise distilled ammonium hydroxide that is sent to the separator, or concentrator, 89. The overhead stream of ammonium hydroxide is then passed via conduit 77. The bottoms is waste water 91.

If, on the other hand, the acid solvent employed is formic acid, the extract stream 47, FIG. 4, to which has been added water stream 45, is sent to the distillation tower 93. The overhead of the distillation tower is the acid solvent which is sent via conduit 51 to be recycled. The bottoms from the distillation tower is the oil containing the high concentration of nitrogenous compounds, shown formerly as the oil stream 53. The oil stream 53 is processed as described hereinbefore.

Figure 5:
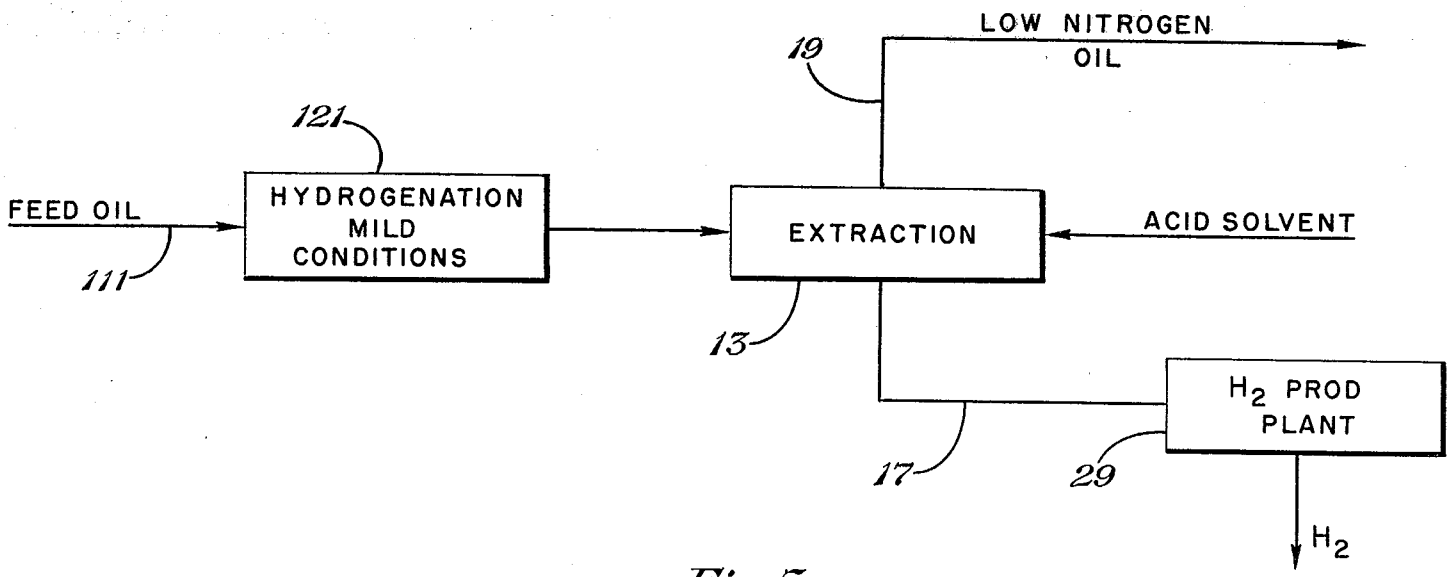
FIG. 5 is a master flow diagram showing broadly the flow of the process in accordance with a second embodiment of this invention involving denitrogenation followed by extraction.

FIG. 5 illustrates the invention employing hydrodenitrogenation followed by extraction. The extraction process for hydrotreated oil is essentially the same as that for the unhydrotreated oil shown in FIGS. 1 and 2. The oil feed stream 11 has, however, a lower nitrogen content than the raw oil; and, hence, less acid is required for extraction and less high nitrogen oil is removed. Specifically, feed oil stream 111 is subjected to hydrogenation in hydrogenation tower 121. The hydrogenation is mild; for example, in the presence of a conventional nickel-molybdenum hydrotreating catalyst at low temperature, high space velocity. The concentration of nitrogenous compounds is reduced. Moreover, the initial hydrogenation, or hydrotreating, is additionally advantageous in that there is less tendency to form troublesome "gunky" residue and there is a smaller high nitrogen content oil stream than with extraction first. In any event the effluent stream 11 is the feed stream for the remainder of the process as described with respect to FIGS. 1–4.

EXAMPLE

A process similar to that shown in FIG. 1 is carried out using a syncrude feed composed of a shale oil formed from Colorado oil shale which contained about 2.0 percent by weight of nitrogenous compounds.

The syncrude feed is mixed with an aqueous phosphoric acid solution containing 42.5 weight percent phosphoric acid. Equal weights of the phosphoric acid solution and the syncrude feed are admixed. The mixing is carried out at about 100° F. and atmospheric pressure for 15 minutes. After admixing, the admixture is passed to a separator and allowed to set for 30 minutes at quiescent conditions. Two phases formed. The overhead, or raffinate phase of lesser density is a low nitrogen syncrude containing less than 0.10 percent by weight nitrogen compounds and substantially free of acid. The second phase contains essentially all of the acid and the high nitrogen syncrude phase contains about 4.7 by weight nitrogen. The low nitrogen syncrude phase is removed from the separator and subjected to mild hydrogenation to produce a satisfactory oil product.

The high nitrogen syncrude phase containing any excess acid is transferred to a neutralizer wherein an aqueous solution containing 58 percent by weight ammonium hydroxide is added. The ammonium hydroxide solution is added in the amount of about 15.3 percent by weight based on the total weight of the high nitrogen syncrude phase. The mixture is then transferred to a separator and separated. The overhead phase is a high nitrogen syncrude phase that is sent to a hydrogen generation plant. The bottoms phase is a separate salt solution phase.

The high nitrogen oil content phase forms a satisfactory feed stock for the hydrogen generation plant 29. In that plant the extraneous compounds resulting from the nitrogenous compounds are hydrotreated and disposed of by either conversion to ammonia or other nitrogen containing products.

As can be seen, the foregoing invention achieves the objects delineated hereinbefore and obviates the deficiencies of the prior art.

Having thus described the invention, it will be understood that such description has been given by way of illustration and example and not by way of limitation, reference for the latter purpose being had to the appended claims.

I claim:

1. A method of denitrogenating oils containing a relatively high content of nitrogenous compounds, comprising:

a. extracting the nitrogenous compounds from the oil stream with an operable acid solvent to produce a raffinate oil having a relatively low concentration of nitrogenous compounds such that said raffinate oil can be hydrodenitrogenated at mild conditions with reduced hydrogen consumption; and a bottom of high content of nitrogenous compounds;

b. recovering the acid solvent from said bottom, simultaneously producing a small volume stream of oil containing a high concentration of nitrogenous compounds and referred to as a high nitrogen content oil;

c. sending said high nitrogen content oil to a hydrogen producing plant for supplying hydrogen for hydrogenation;

d. washing with water said raffinate oil having relatively low concentration of nitrogenous compounds;

e. employing the hydrogen produced in step c. to effect hydrodenitrogenation of the washed raffinate oil by hydrogenating the washed raffinate oil at mild conditions to produce an ultimate product oil stream; and f. recycling said acid solvent.

2. The method of claim 1 wherein said oil is subjected to hydrogenation to lower the concentration of the nitrogenous compounds before the extracting of step a.

3. The method of claim 1 wherein said acid solvent is selected from the class consisting of phosphoric acid, formic acid, and a monoammonium salt of phosphoric acid.

4. The method of claim 3 wherein said acid solvent comprises formic acid.

5. The method of claim 1 wherein said acid is formic acid and said acid solvent recovery is by distillation of the bottoms into the acid solvent and the high nitrogen content oil streams.

6. The method of claim 1 wherein said acid solvent recovery is by neutralization.

7. The method of claim 6 wherein said neutralization is with ammonium hydroxide and produces an extract oil that is washed and the bottom wash is combined with the bottoms from the neutralization to produce a solution from which the acid solvent is recovered and recycled, simultaneously producing ammonium hydroxide which is also recycled to the neutralizing reactor.

8. The method of claim 1 wherein said high nitrogen content oil stream is washed with water before being sent on to its destination in accordance with step c.

* * * * *